US006378917B1

(12) United States Patent
Jones

(10) Patent No.: US 6,378,917 B1
(45) Date of Patent: Apr. 30, 2002

(54) DOOR SECURITY DEVICE WITH A QUICKLY REMOVABLE DOOR STOP

(76) Inventor: Cora J. Jones, 214 Marble La., Lakeland, FL (US) 33809

( * ) Notice: Subject to any disclaimer, the term of this patent is extended or adjusted under 35 U.S.C. 154(b) by 0 days.

(21) Appl. No.: 09/541,649

(22) Filed: Apr. 3, 2000

(51) Int. Cl.[7] ..... E05C 1/04

(52) U.S. Cl. ..... 292/42; 292/53; 292/DIG. 15; 16/82; D8/402

(58) Field of Search ..... 292/DIG. 15, 42, 292/53; 16/82; D8/402

(56) References Cited

U.S. PATENT DOCUMENTS 1,661,240 A * 3/1928 Trimbach ..... 292/5
3,977,714 A * 8/1976 Trotter ..... 292/343
4,198,088 A * 4/1980 Tochihara ..... 292/288
4,303,266 A * 12/1981 Volpi ..... 292/166
4,759,577 A * 7/1988 Thomas, III ..... 292/338
5,383,254 A * 1/1995 Wigley, Sr. ..... 16/82
5,454,143 A * 10/1995 Wigley, Sr. ..... 16/82
5,490,304 A * 2/1996 Winner, Jr. et al. ..... 16/82
5,531,490 A * 7/1996 Parker ..... 292/262
5,601,319 A * 2/1997 Morin ..... 292/139

* cited by examiner

*Primary Examiner*—Anthony Knight
*Assistant Examiner*—Vishaz Patel
(74) *Attorney, Agent, or Firm*—George A. Bode; Lisa D. Velez; Bode & Associates

(57) ABSTRACT

A door security device comprising a quickly removable door stop adapted to be removably coupled to a floor surface having a plurality of spaced apertures in close proximity to a closed door. The quickly removable door stop comprises a handle portion and a plurality of spaced prongs coupled to the handle portion. The plurality of prongs are adapted to be received in a plurality of spaced apertures formed in the floor surface. The door security device preferably also includes a door coupler having a flange with a plurality of aligned apertures adapted to receive the prongs of the door stop.

18 Claims, 3 Drawing Sheets

2
20
22c
32a
25
31a
22b
21
37
40
41c
22a
37
32b
41b
2
37
32a
41a
31a
33b
33a
37
40
25c
37
25
32b
25b
37
33a
21
25a
33b

DOOR SECURITY DEVICE WITH A QUICKLY REMOVABLE DOOR STOP

BACKGROUND OF THE INVENTION

1. Field of the Invention

The present invention relates to door security devices and, more particularly, to a door security device having a quickly removable door stop.

2. General Background

Door chains are widely used to prevent forced entry through a door. However, door chains are limited in their ability to prevent forced entry since a strong force can pull the chain from the door frame.

Several apparatuses have been patented which are aimed at door security devices.

U.S. Pat. No. 4,198,088 issued to J. I. Tochihara, entitled "REMOVABLE DOOR LOCK," discloses a removable door lock for attachment to the bottom of a door. The removable door lock comprises a U-shaped clamp for accepting the lower portion of a door therein; a L-shaped bracket adjustably coupled to the U-shaped clamp; and, thumb screws adapted to be received in a horizontal leg of the L-shaped bracket and engage the floor to prevent articulation of the door.

U.S. Pat. No. 5,531,490 issued to R. D. Parker, entitled "DOOR SECURITY DEVICE ALLOWING PARTIAL DOOR OPENING," discloses a door security device which is adapted to allow partial opening of the door or to pin the door closed. The door security device includes a uniquely shaped door bar having a portion pivotally received in a collar buried in the floor; and, a bracket affixed to the bottom of the door. When the door bar is in one position behind the bracket, the door is pinned in a closed position. Alternately, when the door bar is in another position, the door bar pivots in the collar and allows for partial opening of the door.

U.S. Pat. No. 1,082,432 issued to F. Mertsheimer, entitled "DOOR CHECK"; U.S. Pat. No. 1,723,007 issued to L. A. Bittorf, entitled "DOOR BOLT FIXTURE"; and, U.S. Pat. No. 5,398,982 issued to L. Watson, Jr., entitled "DOOR SECURITY BAR", each disclose a locking bar for a door that is attached to the lower potion of the door and has a portion which moves into a hole in the floor surface.

Other U.S. patents in the art include U.S. Pat. No. 4,330,146 issued to Sessions, Jr., entitled "PORTABLE DOOR LOCK"; U.S. Pat. No. 5,291,760 issued to Schrader, entitled "LOCK FOR DOORS"; and, U.S. Pat. No. 5,685,580, entitled "PORTABLE DOOR LOCKING DEVICE," none of which meet the needs of the present invention.

As will be seen more fully below, the present invention is substantially different in structure, methodology and approach from that of the prior door security devices.

SUMMARY OF THE PRESENT INVENTION

The preferred embodiment of the door security device of the present invention solves the aforementioned problems in a straight forward and simple manner.

Broadly, what is provided is a door security device which comprises a quickly removable door stop adapted to be removably coupled to a floor surface in close proximity to a closed door, wherein the quickly removable door stop comprises: a handle portion; and, a plurality of spaced prongs coupled to the handle portion wherein the plurality of prongs are adapted to be received in the plurality of spaced apertures formed in the floor surface.

Moreover, the quickly removable door stop further comprises: an elongated cross bar which is elongated in a direction parallel to a width of the closed door wherein the handle portion is coupled to a topside of the elongated cross bar and the plurality of spaced prongs are coupled to an underside of said elongated cross bar.

In view of the above, it is an object of the present invention to provide a door security device with a door coupler adapted to be affixed to a bottom end of the door and a door stop coupling flange coupled to the door coupler and having a plurality of apertures spatially arranged to receive the plurality of spaced prongs and which are aligned with the plurality of spaced apertures formed in the floor surface.

Another object of the present invention is to provide a door security device with a door coupler having an adjustable U-shaped channel to accommodate a variety of door thicknesses.

A further object of the present invention is to provide a door security device with a door coupler which comprises: an interior section having a vertical surface adapted to be secured to an interior surface of the door and a first flange adapted to extend beneath the door; and, an exterior section having a vertical surface adapted to be secured to an exterior surface of the door and a second flange adapted to extend beneath the door in overlapping relation with the first flange of the interior section.

A still further object of the present invention is to provide a door security device which includes a door stop coupling flange which is integrated with the vertical surface of the interior section in close proximity to a bottom edge thereof and wherein the first flange is affixed to the vertical surface at an elevation higher than the door stop coupling flange.

A still further object of the present invention is to provide a door security device with a handle adapted to lift all prongs of the plurality of spaced prongs from the floor surface substantially simultaneously via a single lifting movement.

A still further object of the present invention is to provide a door security device which minimizes, if not eliminates, forced entry through a door secured in a closed position by such door security device.

A still further object of the present invention is to provide a door security device with a door coupler which is defined by a variable U-shaped channel to accommodate a variety of door thicknesses wherein vertical surfaces of the variable U-shaped channel are fastened together.

More specifically, the door security device of the present invention comprises: (a) a door coupler having a variable U-shaped channel adapted to be affixed to a bottom end of a door;(b) a flange integrated with said door coupler and having a plurality of spaced apertures formed therein; and, (c) a door stop adapted to be removably coupled to said flange, wherein said door stop comprises: (i) a handle portion; and, (ii) a plurality of spaced prongs coupled to said handle portion wherein said plurality of prongs are adapted to be received in said plurality of spaced apertures of said flange and a plurality of spaced apertures formed in said floor surface and aligned with said plurality of spaced apertures of said flange to prevent appreciable articulation of said door.

In view of the above objects, it is a feature of the present invention to provide a door security device which is simple to install.

Another feature of the present invention is to provide a door security device which is relatively simple structurally and thus simple to manufacture.

A further feature of the present invention is to provide a door security device with includes a door stop which is easy to place in and out of a securing position.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
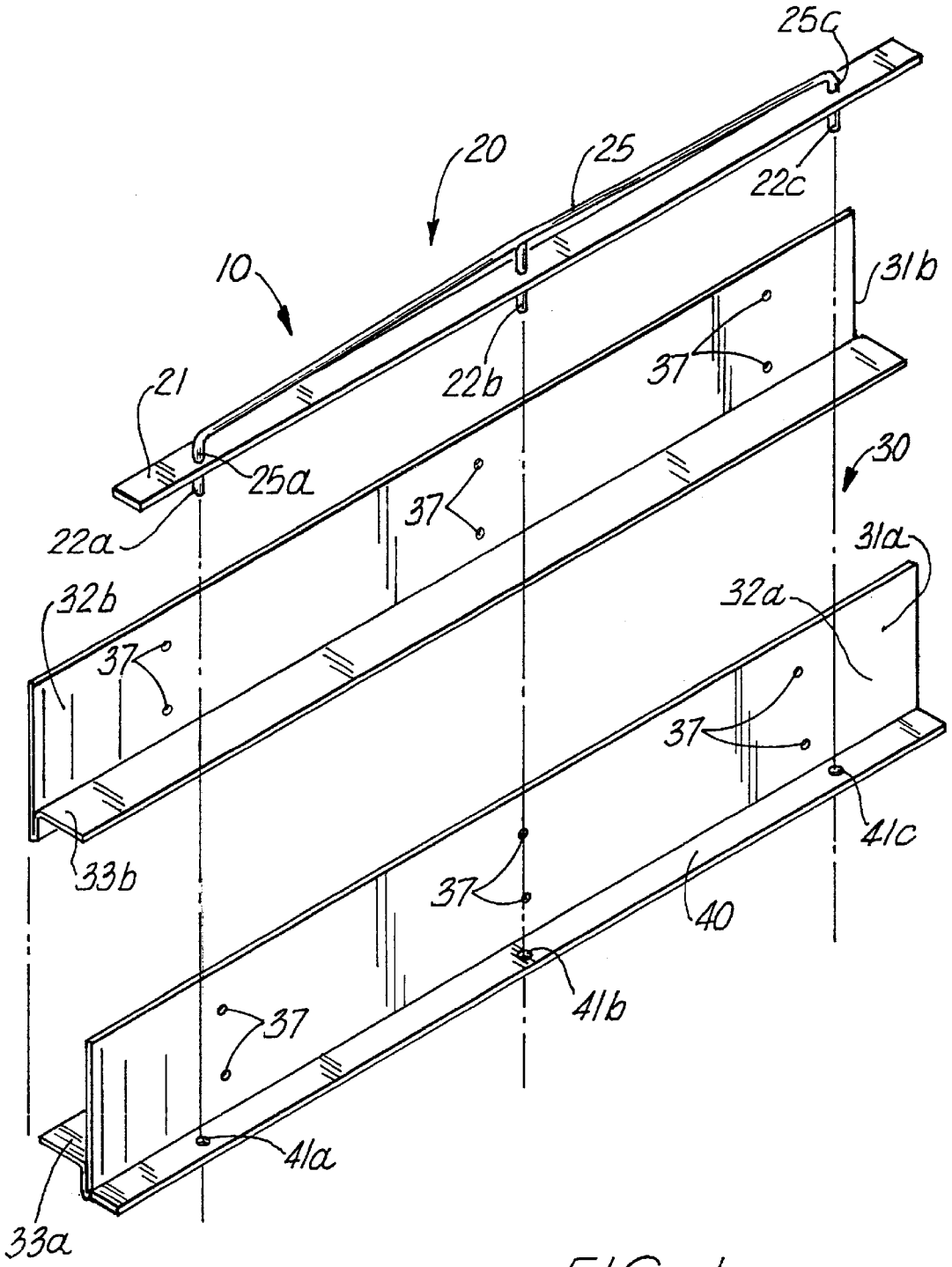
FIG. 1 illustrates an exploded view of the door security device of the present invention.
Figures 2, 3:
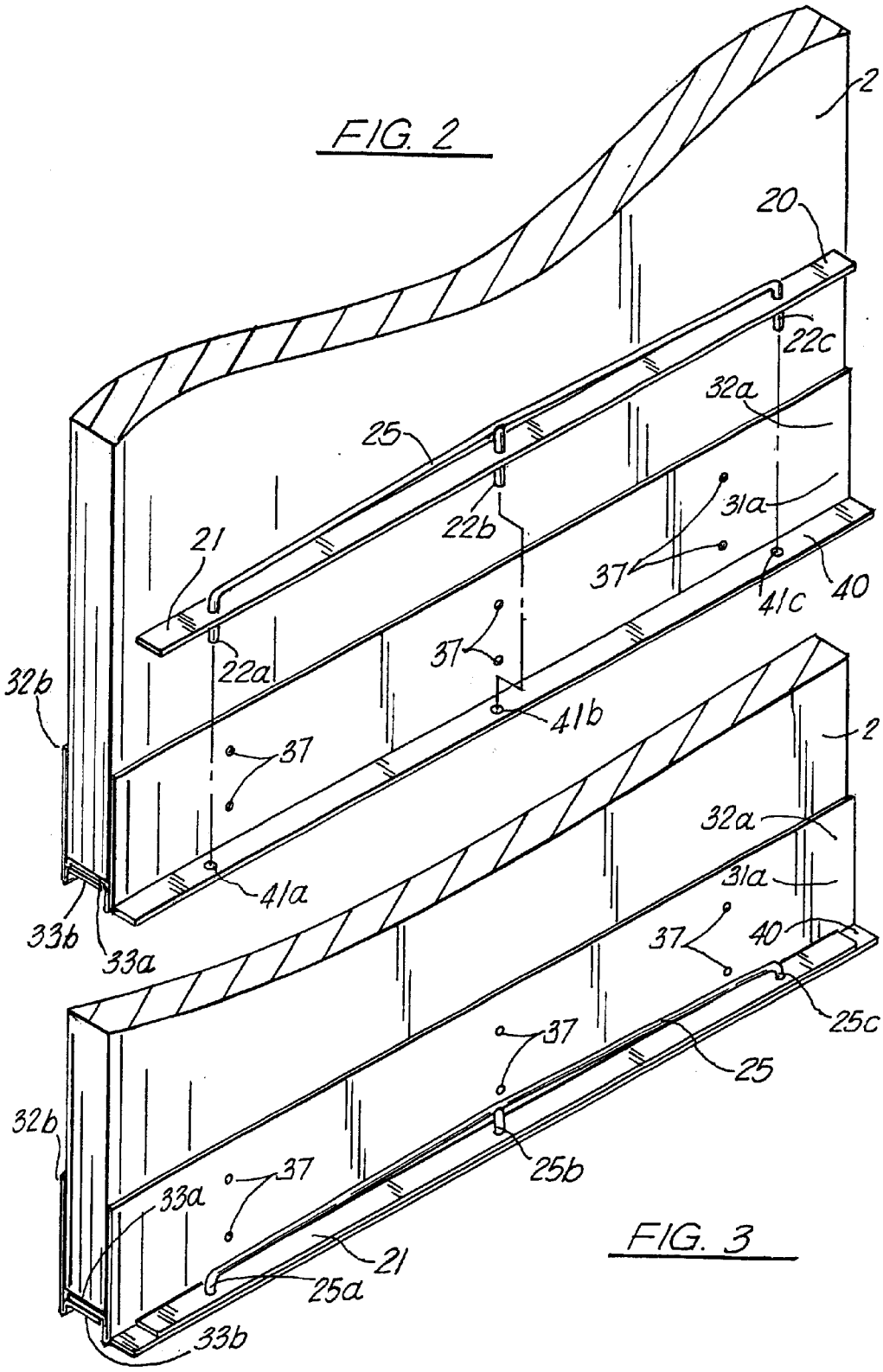
FIG. 2 illustrates an exploded view of the door security device of the present invention secured to a door.
FIG. 3 illustrates a securing state of the door security device of the present invention; and, FIG. 4 illustrates a cross-sectional view of the door security device in the securing state with the door and the fasteners shown in phantom.

Referring now to the drawings and in particular FIGS. 1–3, the door security device of the present invention is generally referenced by the numeral 10. The door security device 10 comprises, in general, a quickly removable door stop 20 having an elongated cross bar 21, a plurality of prongs 22*a*, 22*b*, and 22*c* adapted to be inserted in the floor surface 5 (FIG. 4), and a handle 25 coupled to the topside of elongated cross bar 21. As can be appreciated, the handle allows all prongs of the plurality of spaced prongs 22*a*, 22*b*, and 22*c* to be lifted simultaneously via a single lifting movement. Thus, the occupant has the added protection of the additional prongs without compromising the quickness in which the door stop 20 can be removed from the securing position/state (FIG. 3).

In the preferred embodiment, the door stop 20 is used in conjunction with door coupler 30. However, door stop 20 can be used alone wherein the door stop would have a sufficient height to obstruct the articulation of the door 2 such that it would not be openable when the plurality of prongs 22*a*, 22*b* and 22*c* are inserted into apertures/holes 5*a* in floor surface 5. The door stop 20 can be easily used alone since elongated cross bar 21 and the prongs are essentially balanced and does not necessarily require a bracket or other support structure to hold the door stop 20 or, in other words, to hold the prongs 22*a*, 22*b* and 22*c* in their respective apertures/holes in floor surface 5.

The handle 25 includes handle legs 25*a*, 25*b* and 25*c* in spatial relation which correspond to the spatial arrangement of the plurality of prongs 22*a*, 22*b* and 22*c*. As shown in FIG. 1, legs 25*a*, 25*b* and 25*c* of handle 25 are affixed to the topside of elongated cross bar 21 while prongs 22*a*, 22*b*, and 22*c* are affixed to the underside of elongated cross bar 21. It should be further noted that the number of legs of handle 25 do not have to have a one to one correspondence with the prongs 22*a*, 22*b*, and 22*c*. It should be further noted, that if the elongated cross bar 21 were eliminated, the configuration of door stop 20 would be generally E-shaped.

Figure 4:
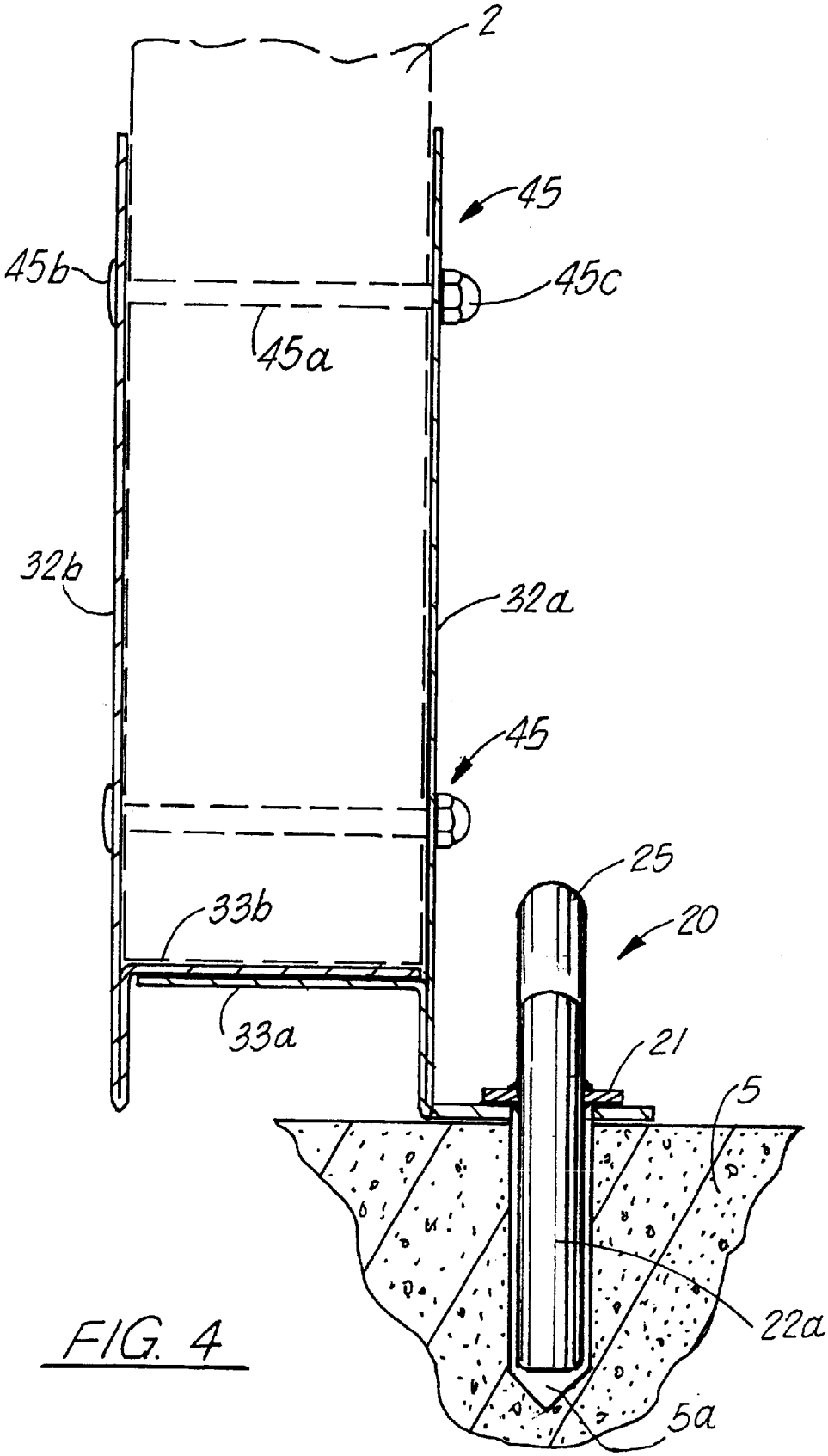

Door coupler 30 comprises, in general, a U-shaped channel, as best seen in FIGS. 2–4, and a door stop coupling flange 40. The U-shaped channel comprises an interior section 31*a* having a vertical surface 32*a* adapted to be secured to an interior surface of the door 2 and a dependent flange 33*a* adapted to extend beneath the door 2; and, an exterior section 31*b* having a vertical surface 32*b* adapted to be secured to an exterior surface of the door 2 and a dependent flange 33*b* adapted to extend beneath the door 2 in overlapping relation with the dependent flange 33*a* of the interior section 31*a*.

The door stop coupling flange 40 is affixed to the vertical surface 32*a* of the interior section 31*a* in close proximity to a bottom edge thereof and the dependent flange 33*a* is affixed to the vertical surface 31*a* at an elevation higher than the door stop coupling flange 40.

The vertical surfaces 32*a* and 32*b* are secured to the door 2 via fasteners 45. In the exemplary embodiment, the vertical surfaces 32*a* and 32*b* each have formed therein a plurality of holes 37 wherein a hole 37 in vertical surface 32*a* is aligned and paired with a hole 37 in vertical surface 32*b*. Hence, a fastener 45 is adapted to be mated with an aligned hole pair of vertical surfaces 32*a* and 32*b*.

Referring now to FIG. 4, the fastener 45 includes a shaft member 45*a* having integrated therewith, on one distal end, a head 45*b* and a threaded nut 45*c* removably coupled to and from the other distal end of the shaft member 45*a*. Preferably, the head 45*b* would engage the vertical surface 32*b* of exterior section 31*b* and shaft member 45*a* would be journalled through a drilled bore hole in door 2. The fastener 45 is secured via threaded nut 45*c* tightened on the treaded end of shaft member 45*a* in a conventional manner.

As can be readily seen, the U-shaped channel, defined by the vertical surface 32*a* and 32*b* and dependant flanges 33*a* and 33*b*, respectively, is variable and accommodates a variety of door thicknesses. Hence, when installing the door coupler, the amount of overlap between dependant flanges 33*a* and 33*b* varies the distance between vertical surfaces 32*a* and 32*b*. Further, it matters not which flange 33*a*, 33*b*, is the upper or lower flange when device 10 is fully assembled, as illustrated in FIGS. 2–4; as FIGS. 2 and 3 show flange 33*a* over flange 33*b* and FIG. 4 shows flange 33*b* over flange 33*a*.

While the preferred embodiment uses a single fastener 45 to coupled both vertical surfaces 32*a* and 32*b* to the opposing sides of the door 2, alternately, vertical surfaces 32*a* and 32*b* may be affixed to the door independently such as via an strong adhesive or separate screws.

During installation, in addition to drilling holes through door 2, a plurality of apertures/holes 5*a* would also be drilled/formed in floor surface 5, as best seen in FIG. 4 wherein the apertures/holes 5*a* are to be aligned with the plurality of apertures 41*a*, 41*b* and 41*c* of door stop coupling flange 40.

In operation, as best seen in FIGS. 2–3, when the door is in a closed position, door stop 20 is placed in a securing position, as best seen in FIG. 3. Door stop 20 is in a securing position when the plurality of prongs 22*a*, 22*b* and 22*c* are received in the apertures/holes 5*a* of the floor surface 5. When the door coupler 30 is used, the plurality of prongs 22*a*, 22*b*and 22*c* are received in both the plurality of apertures 41*a*, 41*b* and 41*c* of door stop coupling flange 40 and the apertures/holes 5*a* of floor surface 5. In both instances, the door security device 10 having the door stop 20 of the present invention gives the occupants an additional locking mean for the door 2 and a sense of security.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A door security device comprising:

a quickly removable door stop adapted to be removably coupled to a floor surface having a plurality of spaced apertures in close proximity to a closed door, wherein said quickly removable door stop comprises:

(a) a handle portion;

(b) a plurality of spaced prongs coupled to said handle portion, wherein said plurality of prongs are adapted to be received in said plurality of spaced apertures formed in said floor surface; and, (c) an elongated cross bar which is elongated in a direction parallel to a width of said closed door wherein said handle portion is coupled to a top side of said elongated cross bar and said plurality of spaced prongs are coupled to an underside of said elongated cross bar.

2. The device of claim 1, wherein said plurality of spaced prongs comprises three prongs wherein each prong of said plurality of spaced prongs are parallel to each other.

3. The device of claim 2, wherein said handle portion is adapted to lift all prongs of said plurality of spaced prongs from said floor surface simultaneously via a single lifting movement.

4. The device of claim 1, further comprising a door coupler adapted to be affixed to a bottom end of said door and a door stop coupling flange integrated with said door coupler and having a plurality of apertures spatially arranged to receive said plurality of spaced prongs and which are aligned with said plurality of spaced apertures formed in said floor surface, wherein said door coupler comprises:

(a) an interior section having a vertical surface adapted to be secured to an interior surface of said door and a first flange adapted to extend beneath said door; and, (b) an exterior section having a vertical surface adapted to be secured to an exterior surface of said door and a second flange adapted to extend beneath said door in overlapping relation with said first flange of said interior section.

5. The device of claim 4, wherein said door stop coupling flange is affixed to said vertical surface of said interior section in close proximity to a bottom edge thereof and said first flange is affixed to said vertical surface at an elevation higher than said door stop coupling flange.

6. The device of claim 5, wherein said vertical surface of said interior section and said vertical surface of said exterior section are affixed to said door via a plurality of fasteners.

7. A door security device comprising:

(a) a U-shaped channel adapted to be affixed to a bottom end of a door;

(b) a flange coupled to said U-shaped channel having a plurality of spaced apertures formed therein; and, (c) a quickly removable door stop adapted to be removably coupled to a floor surface in close proximity to a closed door, wherein said quickly removable door stop comprises:

(i) an elongated cross bar;

(ii) a handle coupled to a topside of said elongated cross bar; and, (iii) a plurality of spaced prongs coupled to an underside of said elongated cross bar, wherein said plurality of prongs are adapted to be received in said plurality of spaced apertures of said flange and said plurality of spaced apertures formed in said floor surface to prevent appreciable articulation of said closed door.

8. The device of claim 7, wherein said plurality of spaced prongs comprises three prongs.

9. The device of claim 7, wherein each prong of said plurality of spaced prongs are parallel to each other.

10. The device of claim 9, wherein said handle is adapted to lift all prongs of said plurality of spaced prongs from said floor surface and said flange simultaneously via a single lifting movement.

11. The device of claim 7, wherein said U-shaped channel comprises:

(a) an interior section having a vertical surface adapted to be secured to an interior surface of said door and a first flange adapted to extend beneath said door; and, (b) an exterior section having a vertical surface adapted to be secured to an exterior surface of said door and a second flange adapted to extend beneath said door in overlapping relation with said first flange of said interior section.

12. The device of claim 11, wherein said flange is affixed to a bottom edge of said vertical surface of said interior section and said first flange is affixed to said vertical surface at an elevation higher than said flange.

13. The device of claim 12, wherein said vertical surface of said interior section and said vertical surface of said exterior section includes a plurality of sets of paired holes wherein each paired holes are adapted to receive a fastener capable of securing both of said vertical surfaces of said interior section and said exterior section to opposite sides of said door.

14. A door security device comprising:

(a) a door coupler having a variable U-shaped channel adapted to be affixed to a bottom end of a door;

(b) a flange integrated with said door coupler and having a plurality of spaced apertures formed therein; and, (c) a door stop adapted to be removably coupled to said flange, wherein said door stop comprises:

(i) a handle portion; and, (ii) a plurality of spaced prongs coupled to said handle portion, wherein said plurality of prongs are adapted to be received in said plurality of spaced apertures of said flange and a plurality of spaced apertures formed in said floor surface and aligned with said plurality of spaced apertures of said flange to prevent appreciable articulation of said door.

15. The device of claim 14, wherein said door stop further comprises: (iii) an elongated cross bar which is elongated in a direction parallel to a width of said closed door wherein said handle portion is coupled to a topside of said elongated cross bar and said plurality of spaced prongs are coupled to an underside of said elongated cross bar.

16. The device of claim 14, wherein said handle portion is adapted to lift all prongs of said plurality of spaced prongs from said floor surface simultaneously via a single lifting movement.

17. The device of claim 14, wherein said variable U-shaped channel comprises:

(a) an interior section having a vertical surface adapted to be secured to an interior surface of said door and a first flange adapted to extend beneath said door; and, (b) an exterior section having a vertical surface adapted to be secured to an exterior surface of said door and a second flange adapted to extend beneath said door in overlapping relation with said first flange of said interior section.

18. The device of claim 17, wherein said vertical surface of said interior section and said vertical surface of said exterior section includes a plurality of sets of paired holes wherein each paired holes are adapted to receive a fastener capable of securing both of said vertical surfaces of said interior section and said exterior section to opposite sides of said door.

* * * * *